United States Patent [19]

Brown et al.

[11] 4,314,142

[45] Feb. 2, 1982

[54] SPATIALLY DISTRIBUTED ELECTROSTATIC PERFORATION OF MOVING WEBS

[75] Inventors: William D. Brown, Brevard; Hobart A. Whitman, III, Asheville, both of N.C.

[73] Assignee: Olin Corporation, Pisgah Forest, N.C.

[21] Appl. No.: 171,110

[22] Filed: Jul. 22, 1980

Related U.S. Application Data

[62] Division of Ser. No. 32,332, Apr. 23, 1979, Pat. No. 4,253,010.

[51] Int. Cl.[3] ..... H05B 7/18

[52] U.S. Cl. ..... 219/384; 73/38; 83/16; 219/121 EM; 264/154

[58] Field of Search ..... 83/16, 170, 171, 360, 83/365; 131/15 R, 15 B; 219/121 EM, 121 EB, 383, 384, 502, 509, 492; 346/74, 74 SB, 150, 163; 73/38; 93/1 R, 1 G; 156/272, 274; 162/139, 192, 286; 264/154, 156; 315/326

[56] References Cited

U.S. PATENT DOCUMENTS

| | | | |
|---|---|---|---|
| 2,372,508 | 3/1945 | Mcaker | 219/384 |
| 2,982,186 | 5/1961 | McKeen | 93/1 G |
| 3,098,143 | 7/1963 | Warmt | 219/384 |
| 3,167,641 | 1/1965 | Parmele et al. | 219/384 |
| 3,348,022 | 10/1967 | Schirmer | 219/384 |
| 3,358,378 | 12/1967 | Downs | 34/1 |
| 3,475,591 | 10/1969 | Fujii et al. | 219/384 |
| 3,783,237 | 1/1974 | McArthur | 219/384 |
| 4,025,752 | 5/1977 | Whitman | 219/384 |
| 4,029,938 | 6/1977 | Martin | 219/384 |
| 4,035,611 | 7/1977 | Martin et al. | 219/384 |

*Primary Examiner*—Volodymyr Y. Mayewsky
*Attorney, Agent, or Firm*—Kerkam, Stowell, Kondracki & Clarke

[57] ABSTRACT

A method and apparatus for controlling the perforation of webs being moved in a longitudinal direction, by an array of electrodes spatially distributed in a transverse direction, wherein selected control electrodes are added to or removed from the electrode array to provide a transverse, or spatial, degree of control over web porosity. Synchronized sensing of multiple point transverse web porosity, combined with logic circuitry provides the controls for selection and actuation of the appropriate control electrodes. A combined temporal and spatial porosity control embodiment is disclosed. The combined and alternate embodiments described are particularly useful for perforating paper, film, and like materials, where a high degree of area-balanced porosity control is desired.

7 Claims, 6 Drawing Figures

REMOVE
ADD
112
120
142 A,N

POROSITY CONTROL CIRCUITRY OF U.S. 4,025,752
PULSE GENERATOR
POROSITY INDICATOR
PRESSURE DETECTOR
16*
30*
28*
26a*
122
146
144
124
132
144D
144B
144A
142D
142B
142A
130D
130C
130B
130A
134
126N
126D
126C
126B
126A
128
12
140
138
136
LANE 26 N
LANE 26 D
LANE 26 C
LANE 26 B
LANE 26 A
VACUUM LINE 62 FROM FIG. 2.
ADD & REMOVE RELAYS FIG. 4.

SPATIALLY DISTRIBUTED ELECTROSTATIC PERFORATION OF MOVING WEBS

This application is a division of application Ser. No. 032,332, filed Apr. 23, 1979, now U.S. Pat. No. 4,253,010.

DESCRIPTION

1. Technical Field

The present invention relates generally to the controlled perforation of moving webs of paper, film, and like materials, wherein the web is perforated by intermittent arcing between electrode arrays through which it is routed. More specifically, the invention relates to apparatus and methods for controlling the perforation along both the longitudinal and transverse axes of the web by selectively energizing a spatially distributed array of electrodes to accomplish the porosity control.

2. Background of the Prior Art

Apparatus and methods for perforating moving webs using controlled electrostatic discharges across electrodes are well known in the art of imparting a desired degree of porosity to materials such as paper, film, and the like. Typically, such devices utilize various types of pin or needle arrangements for the discharge electrodes in combination with a stationary or rotating member as the ground electrode, as shown in U.S. Pat. Nos. 3,098,143; 3,348,022, and others. All of these devices suffer from the drawback that the discharge electrode pins tend to degrade rapidly by electro-thermal erosion from the high heat generated during arcing between the pins and the ground electrodes. Such degradation changes the gap between the electrodes and corrodes and insulates the points of the pin electrodes causing the pins to misfire resulting in non-uniform perforation of the web material.

Other types of electrodes have been employed such as spaced pairs of oppositely rotating wheels, or discs, between which the web material is passed, as disclosed in U.S. Pat. Nos. 2,372,508 and 3,167,641. More recently, improved multiple arrays of disc electrodes have been employed to address the problems inherent in electrode wear, and subsequent non-uniform perforation of the material being processed. U.S. Pat. Nos. 4,029,938 and 4,055,611 disclose such multiple rotation disc electrode arrangements.

All of the prior art devices enumerated above which include means for controlling the discharge arc and attendent perforation size, employ some combination of duty cycle modulation and/or pulse repetition rate modulation as the controlling factor. Generally, the time modulated arcs are applied to a web being transported longitudinally producing a dashed line of perforations along the length of the web. Such single axis control technique has been useful in controlling the porosity of webs. However, this single axis modulation has been unable to compensate for electrode wear occuring in the direction transverse to the moving web. While the available apparatus and methods represent useful solutions to a number of difficulties associated with transversely arrayed electrodes used for moving web perforation, none have completely addressed the key aspect of porosity control—that of providing means for sensing, controlling, and modulating the transverse porosity of the web.

BRIEF SUMMARY OF INVENTION

The present invention is directed towards controlling the porosity of longitudinally transported webs by introducing a spatial modulation onto the transversely arrayed perforating means, thereby providing control over the transversely distributed porosity of the web. Whereas conventional apparatus for controlling the porosity of webs undergoing perforation while being transported through an array of transversely disposed perforating means, is largely limited to controlling the duty-cycle, on/off, or temporal, modulation of the perforating means, the present invention either substitutes or adds the spatial control capability. Thus, porosity control of moving webs may be accomplished either by spatial modulation alone, or by a combination of spatial and temporal modulations applied to the perforating means. The resulting perforated product takes on a greatly improved porosity distribution which can be controlled along two axes, two degrees of freedom in the perforation process to provide a highly uniform porosity, or to provide a controlled porosity distribution along a particular web axis.

It is therefore a primary object of the present invention to provide improved apparatus and methods for controlling the perforation of webs by exercising new modes of control in the perforation process.

Another object of the present invention is to provide precise control of the porosity of electrostatically perforated webs by introducing a spatial modulation to transversely arrayed electrodes used to perforate the webs.

A further object of the present invention is to provide apparatus and methods for improving the uniformity of transverse porosity of webs perforated by being passed longitudinally through an array of perforating means.

Another object of the present invention is to provide precise control of the porosity of electrostatically perforated webs by combining a spatial modulation of the transversely arrayed electrodes with a temporal modulation of the electrodes to provide an additional axis along which porosity control may be exercised.

A further object of the present invention is to provide apparatus and methods for improving the uniformity of the area-distributed porosity of webs perforated by being longitudinally passed through transversely arrayed perforating means.

Another object of the present invention is to provide webs of paper, film and other similar materials, having precisely controlled porosities, and especially having porosities with known, predetermined distributions along the longitudinal and transverse directions of the web.

A further object of the present invention is to provide webs of paper, film, and the like materials having a uniform distribution of porosity transverse to the longitudinal direction of the web, or having an area-balanced porosity for any area of the web.

BRIEF DESCRIPTION OF DRAWINGS

Additional objects and advantages of the invention will become apparent to those skilled in the art as the description proceeds with reference to the accompanying drawings wherein.

DETAILED DESCRIPTION OF INVENTION

Figure 1:
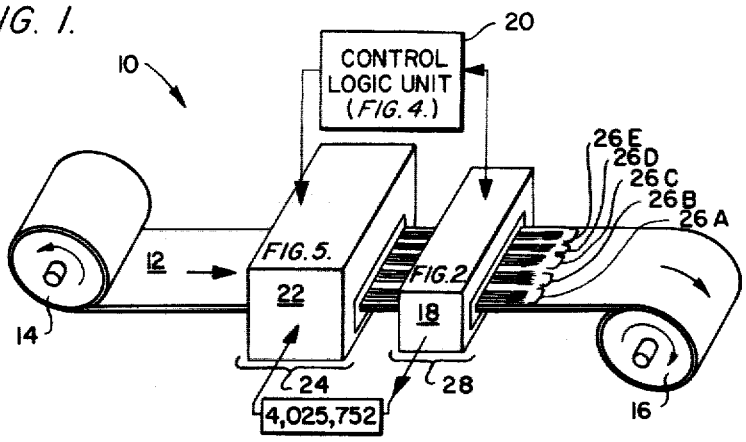
FIG. 1 is a simplified overall diagram of the spatially distributed electrode perforation system according to the present invention.

Referring now to FIG. 1, there is shown a simplified overall diagram of the spatially distributed electrostatic perforation system according to the present invention. The overall system 10 is comprised of several major processing units which act upon a moving web 12 being drawn from a supply roll 14 and being collected on a take-up reel 16, by drive means (not shown). The processing units are a porosity detection and control unit 18, which exchanges control signals with a control logic unit 20, and an electrode switching unit 22 which responds to processed control signals from the control logic unit 20. An electrode excitation unit (designated as U.S. Pat. No. 4,025,752), which responds to control signals from the porosity detection and control unit 18 and provides excitation to the electrode switching unit 22 may, in selected embodiments, also comprise part of the present invention. The teachings of U.S. Pat. No. 4,025,752 to Whitman, III, are incorporated by reference herein.

A brief overview of the system 10 is facilitated with continued reference to FIG. 1. The electrode unit 22 is positioned at a perforating station 24 such that an internal array of electrodes are disposed transverse to the direction of movement of the web 12. The electrodes are arranged in groups and are controllably energized both temporally and spatially to accomplish web perforation via conventional high voltage electrostatic arc discharges. The resulting perforation patterns are shown in exaggerated form in the web 12 as bands 26A–26E. Each group of electrodes produces a particular band of perforations. The porosity unit 18 is positioned at a sensing station 28, slightly downstream of the perforating station 24. This unit develops sequential measurements of web porosity at a plurality of points located transversely across the web, and directs control signals corresponding to the sensed porosities to the logic unit 20. The logic unit 20 provides sequencing signals to, and accepts porosity related control signals from the porosity unit 18. After logically processing the incoming porosity control signals, the logic unit 20 provides switching signals to the electrode unit 22 to control the number of electrodes in each group actually contributing to web porosity. In this manner, web porosity is is both sensed and controlled at a plurality of regions spatially disposed transverse to the direction of web movement. The electrode excitation unit of U.S. Pat. No. 4,025,752 also receives porosity related control signals from the porosity unit 18, and in the selected embodiments, provides closed loop time modulated excitation to the electrodes of electrode unit 22 to control web porosity.

Figure 2:
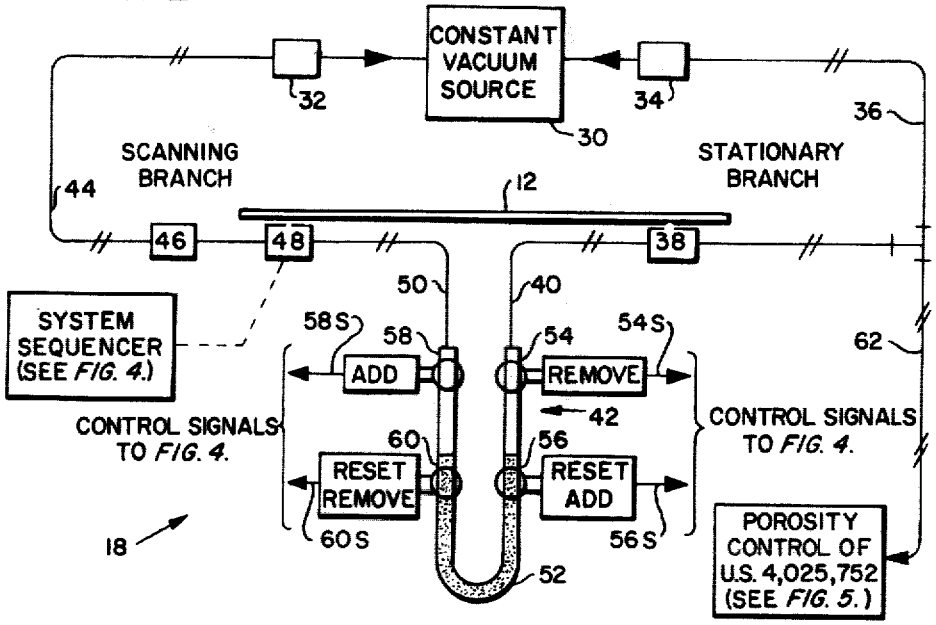
FIG. 2 is a schematic diagram of a porosity detection and control unit.

Referring now to FIG. 2, there is shown a schematic diagram of a porosity detection and control unit 18 according to the present invention. The porosity unit 18 employs a vacuum/manometer technique for simultaneously sensing the porosity of a web for at least two separate locations, and thereafter provides system control signals corresponding to the relative porosities sensed. The porosity unit 18 is comprised of a constant vacuum source 30 which communicates with a two branch measuring circuit via a pair of constant flow regulators 32 and 34. The branch containing the regulator 34, hereinafter designated as the stationary branch, is routed by a vacuum line 36 to a stationary porosity detector assembly 38, and thereafter via a vacuum line 40 to a first side of a U-shaped manometer assembly 42. The branch containing the regulator 32 hereinafter designated as the scanning branch, is routed via a vacuum line 44 and an overpressure release mechanism 46 to a scanning porosity detector assembly 48, and thereafter via a vacuum line 50 to a second side of the manometer assembly 42. The manometer 42 is filled with an opaque liquid 52 which, together with four suitably positioned light source/photocell detectors, functions to provide the control signals indicating the relative porosity sensed by the porosity detectors 38 and 48. A light source/photocell detector (hereinafter for simplicity designated light detector) 54 is located near the top of the stationary branch side of manometer 42, and a light detector 56 is located at an intermediate height on the same manometer side. Light detectors 58 and 60 are positioned in corresponding locations in the scanning branch side of manometer 42. When the manometer 42 is sensing substantially balanced vacuum conditions in its two branches, both light detectors 56 and 60 are optically blocked by the opaque fluid 52 and provide corresponding electrical control signals on their companion signal lines 56S and 60S. Also for this condition, light detectors 54 and 58 are optically clear of opaque fluid 52, and provide corresponding electrical control signals on their companion signal lines 54S and 58S. This balanced situation is the one depicted in FIG. 2. The nature of these control signals, and their contribution to the present invention is discussed in detail in connection with the description of logic unit 20, shown in FIG. 4.

Figures 5, 5A:
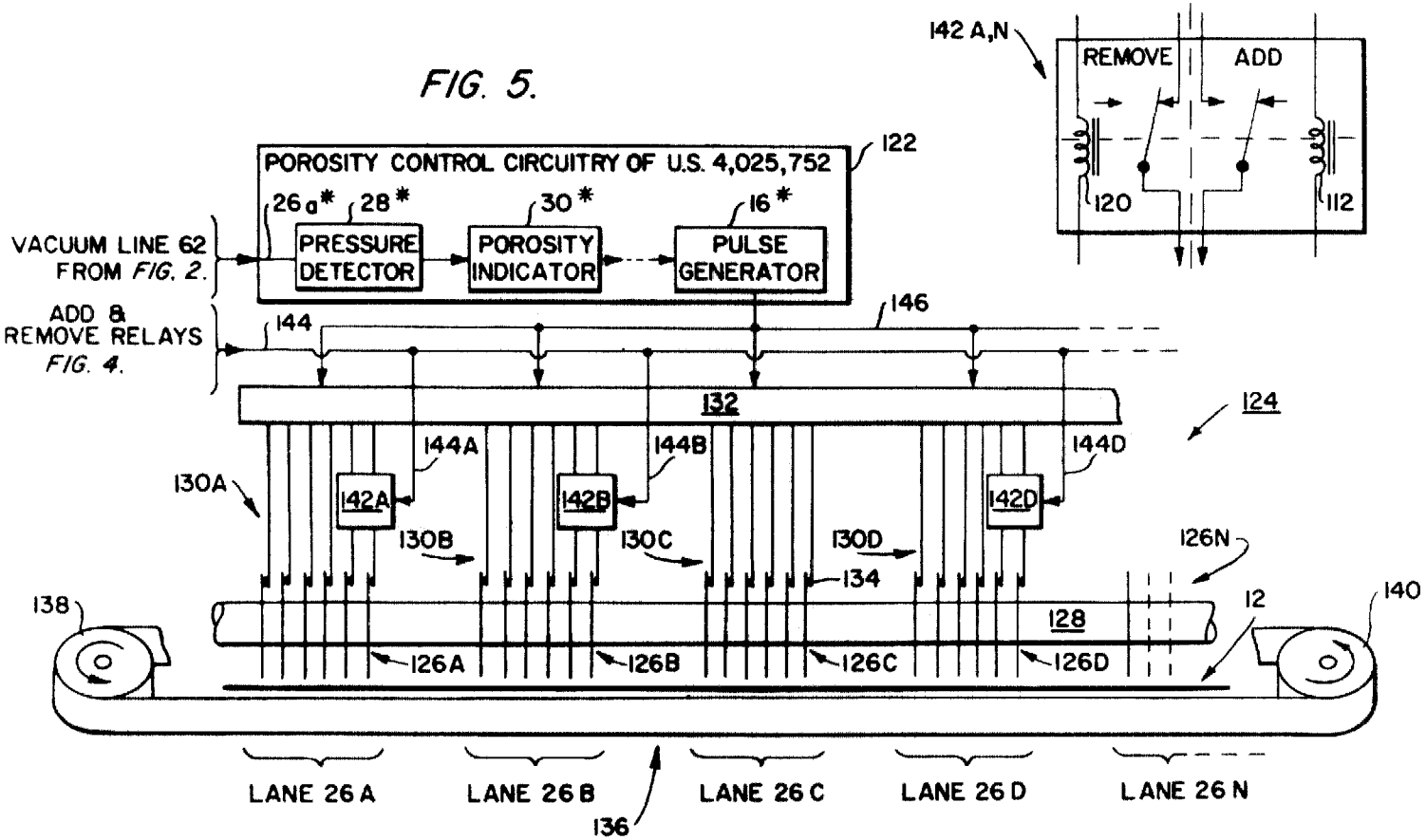
FIG. 5 is a composite circuit diagram of an electrode switching unit and an electrode excitation assembly.
FIG. 5A is a circuit diagram of each of the switching assemblies 142 illustrated in a composite circuit diagram of FIG. 5.

An additional vacuum line 62 is routed from the stationary branch to the porosity control circuitry shown in simplified block form, labeled, "see FIG. 5." The porosity control circuit shown there, and as taught in the aforementioned U.S. Pat. No. 4,025,752, provides a time modulated high voltage source which is applied to the individual electrodes of electrode unit 22. This temporal control of the excitation applied to the electrode unit 22 is, therefore, a direct result of the vacuum level present on vacuum line 62, which corresponds to the porosity sensed by the stationary porosity detector 38.

Figure 3:
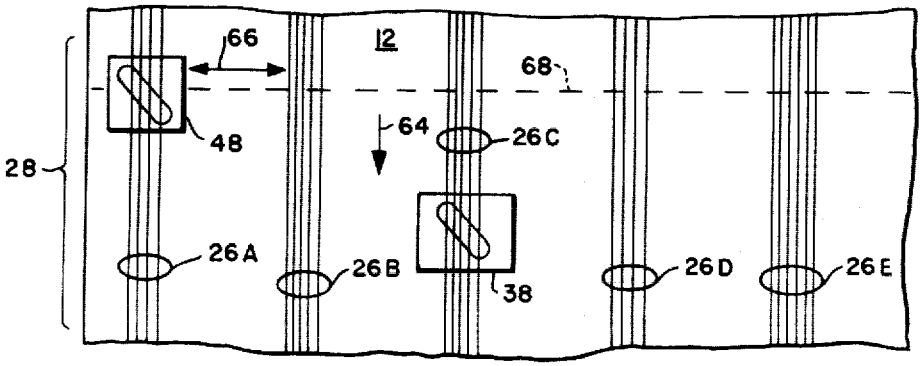
FIG. 3 is a detailed view of a five lane perforated web showing the relative positioning of a fixed porosity detector and a scanning porosity detector.

The scanning porosity detector assembly 48 is shown by dashed lines as being articulated by a system sequencer. The operation of this system sequencer will be described in connection with control logic unit 20 of FIG. 4. The action contemplated here is best illustrated by reference to FIG. 3, with continuing reference to FIG. 2. FIG. 3 shows a detailed view of the moving web 12 after having been perforated. Note in particular the perforations designated 26A–26E and their relationship to the porosity detectors 38 and 48. The configuration shown depicts longitudinal web movement in the direction of arrow 64. Both porosity detector 38 and 48 are shown disposed at station 28, but they may be slightly displaced longitudinally, as shown. Stationary porosity detector 38 is shown sensing the web porosity straddling the perforations of band 26C. The term band is used herein to denote the specific group of perforations in the web 12; and the term lane denotes the apparatus channel (including a specific group of electrodes) associated with the specific group of perforations. Hereinafter, where it is not necessary to distinguish between the two, the terms will be used interchangeably. The porosity sensed at this location is used as the reference porosity for both the combined porosity technique of the present invention, as well as for the temporal porosity technique of U.S. Pat. No. 4,025,752. Scanning porosity detector 48 is shown as sensing the web porosity straddling the perforations of line 26A, however, an arrow 66 indicates the transverse repositioning capability of porosity detector 48. The scanning porosity detector 48 may be transversely repositioned along a dashed line 68 to sense the porosity of any of the lanes of perforations 26A–26E. This repositioning may be accomplished in discrete increments to periodically track the center of each lane of perforations, or it may be accomplished as a uniform or linear sweeping action. In either event, the scanning action is done in synchronous cooperation with the system sequencer such that the exact location of the scanning porosity detector 48 is known, and that the proper phasing with other parts of the system are achieved. Thus, there would be presented to the stationary branch and scanning branch sides of manometer 42 vacuum levels representing the relative porosities sensed by the porosity detectors 38 and 48. The levels in effect would be measures of sensed porosity of web 12 for the transverse locations corresponding to lanes 26A, 26B, 26D and 26E, as referred to the reference lane 26C. In the alternate embodiments, the scanning porosity detector 48 shown in FIGS. 2 and 3 as a single unit may be comprised of a plurality of porosity sensors transversely distributed along the dashed line 68 to cover all perforation lanes. In this case, a system sequencer would merely select the particular porosity detector which corresponded to some desired predetermined perforation lane, and the control logic unit 20 would use the porosity sensed at that selected location to implement the present invention.

FIGS. 1 and 3 show five distinct lanes of perforations widely spaced across the web 12, merely for simplicity of exposition. As detailed in FIG. 3, lanes 26A and 26D are shown as having four active lines of perforations, while lanes 26B and 26C show five lines of perforations and lane 26E shows six lines of perforations. Actually, the perforating electrode spacing, and hence the individual lines and lanes of perforations might be more uniformly distributed across the web, and a substantially greater number of perforating electrodes may be used to provide a more homogeneous finished product. For control purposes, however, the electrodes would continue to be defined in terms of electrode groups, and the resulting perforations in terms of lanes, regardless of how they are spatially distributed.

Figure 4:
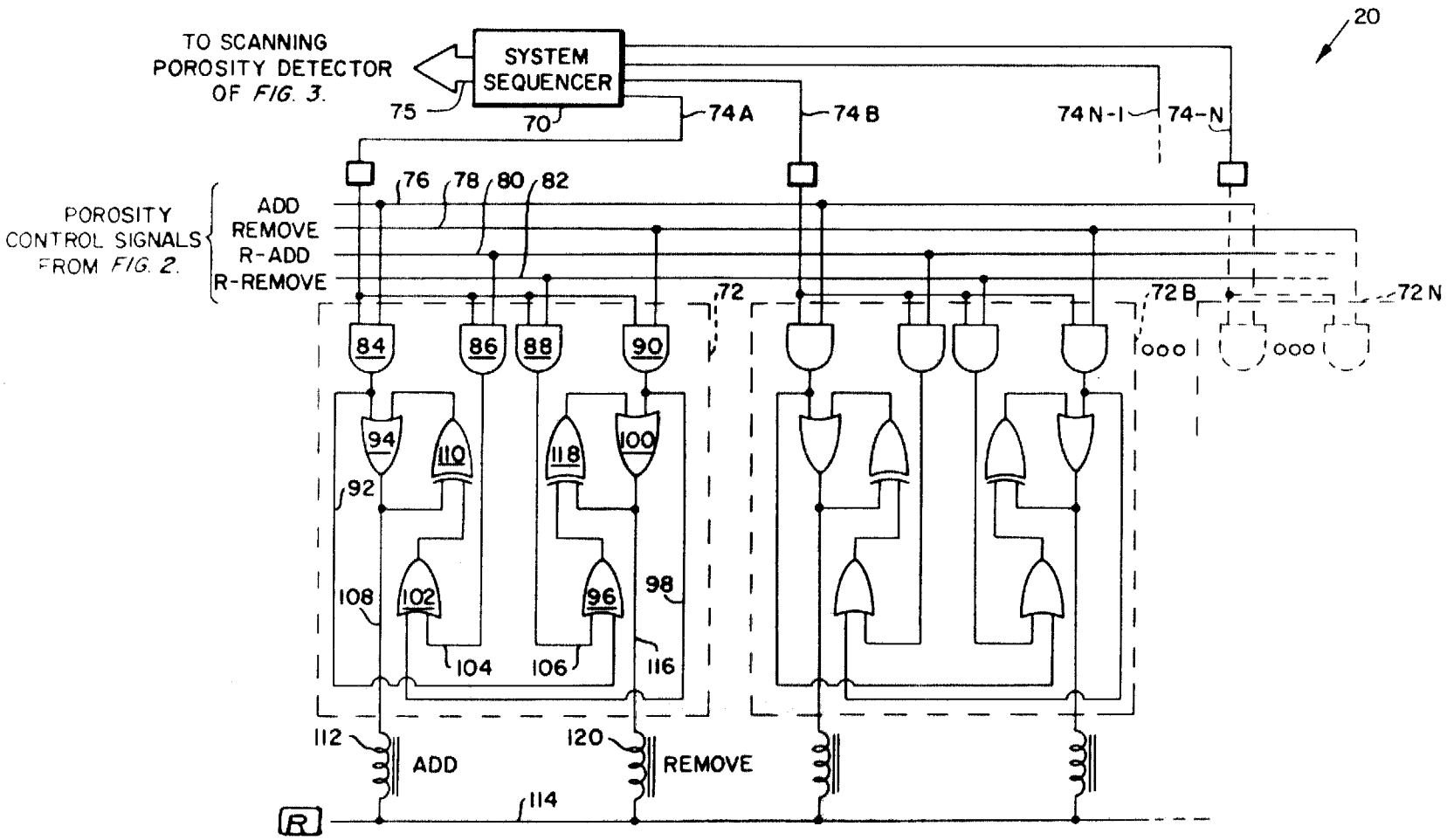
FIG. 4 is a logic diagram of the control logic unit.

Referring now to FIG. 4, there is shown a logic diagram of the control logic unit 20. The logic unit 20 is comprised of a system sequencer 70 interconnected with a plurality of electrode switching modules 72A–72N. The switching modules are identical as to structure and function, and are equal to the number of controlled groups of electrodes within the electrode unit 22. Numerically, there is one less switching module than there are total groups of electrodes as the reference group—the group which produces the perforations of lane 26C of FIGS. 1 and 3—does not require the switching feature. In the interest of brevity, only two switching modules are shown in their entirety. As is clear by the interconnection of the modules, any desired number can be accommodated by simple iteration of their input/output circuits. The sequencer 70 periodically provides select signals, in turn, to each switching module, and synchronously provides properly phased position order signals to the scanning porosity detector 48. The sequencer 70, shown in simplified block form, may be configured as any conventional electronic circuit (or electromechanical device) capable of providing the functions of a pair of synchronously operated single-pole-multiple-throw switches actuated in a stepped fashion to provide a repetitive operating cycle. One pole being used to initiate the select signals, the other pole being used to provide the position order signals. The select signals are applied at compatible logic levels via a plurality of lines 74A–74N to correspondingly numbered switching modules 72A–72N. The select signals are applied in parallel to a first input of all of the four AND gates 84, 86, 88 and 90, which serve as the input elements of each module. The position order signals are applied via a group of lines 75 to position the scanning porosity detector 48 of FIG. 3 such that the porosity of the lane of perforations sensed corresponds to the like lettered electrode switching module selected. This is, apply position orders to the scanning porosity detector 48 such that it senses the porosity of lane 26A, and synchronously apply select signals to the electrode switching module 72A. The exact form of the positioning order signals is not detailed here, as they would be highly specific to the particular type of scanning mechanism employed. To meet the scanning needs of the present invention, any conventional positioning servomechanism (a type 0, or a type 1 servo) both well within the purview of the routiner, would serve adequately. Additionally, alternate embodiments wherein the scanning porosity detector 48 is not physically scanned are also contemplated by the present invention. Whatever the actual scanning means, it is merely required that the sequencer 70 control the scanning porosity detector position at desired predetermined times, or alternately, have knowledge of which lane of perforations is being sensed at any particular time so that suitably phased select signals may be applied to the corresponding switching module.

A set of porosity control signals derived from the light detectors of FIG. 2 are also applied to the switching modules 72A–72N. An Add signal from the light detector 58 of FIG. 2 is applied via a line 76 to a second iput of the first AND gate 84 of each module, while a Remove signal from the light detector 54 is applied via a line 78 to a second input of the fourth AND gate 90 of each module. A Reset Add signal from light detector 56 of FIG. 2 is applied via a line 80 to a second input of the second AND gate 86 of each module, and a Reset Remove signal from light detector 60 is applied via a line 82 to a second input of the third AND gate 88 of each module.

Switching module 72A which as hereinbefore set forth is comprised of four input AND gates 84–90, each of which has a first one of its inputs connected together and routed to the sequencer 70 via the line 74A. Outputs of the AND gate 84 are routed via a line 92 to a first input of an OR gate 94 and to a first input of an OR gate 96. Similarly, outputs of the AND gate 90 are routed via a line 98 to a first input of an OR gate 100 and to a first input of an OR gate 102. An output from AND gate 86 is routed via line 104 to a second input of the OR gate 102, and similarly an output from AND gate 88 is routed via line 106 to a second input of the OR gate 96. Outputs from OR gate 94 are routed via a line 108 to a first input of an exclusive OR gate 110, and further via a line driver (not shown) to a first end of an Add relay 112 FIG. 5A. The other end of Add relay 112 is connected to a suitable reference level R via a line 114. Outputs from OR gate 100 are routed via a line 116 to a first input of an exclusive OR gate 118, and further via a line driven (not shown) to a first end of a Remove relay 120. The other end of Remove relay 120 is routed to the reference level R via the line 114. Exclusive OR gate 110 has its second input driven by an output of OR gate 102, and provides its output to a second input of OR gate 94. In like manner, exclusive OR gate 118 has its second input driven by an output of OR gate 96, and provides its output to a second input of OR gate 100.

Functionally, the circuitry described comprises a pair of cross-coupled OR gates (one an exclusive OR gate) used to implement a pair of latches, one of which controllably energizes the Add relay 112, and the other of which controllably energizes the Remove relay 120. The action of the select signals on lines 74A–74N in combination with the two latches is readily described in terms of the number of logic states resulting, and especially by the action of these states on the Add relay 112 and Remove relay 120. For ease of description, the three resulting states have been arranged into Table 1, along with a number of related system parameters. Detailed circuit functional description is best done by use of selected examples including the interaction of control logic unit 20, and especially the switching modules 142A–142N, with the remainder of the system, including especially the action of the porosity control signals derived from the manometer assembly 42. This functional description will follow the structural description of the electrode switching unit 22.

Referring now to FIG. 5, there is shown a composite circuit diagram of an electrode switching unit 22 especially configured to embody the spatially distributed porosity controlling technique of the present invention when used in conjunction with the porosity control circuitry of U.S. Pat. No. 4,025,752, shown in simplied form as electrode excitation unit 122. Electrode excitation unit 122 contains a pulsed high voltage supply which is used to energize the electrodes contained on the composite assembly 124. For ease of correlation, the appropriate elements of U.S. Pat. No. 4,025,752 are numbered with their original circuit designations, followed by an asterisk. An array of disc electrodes arranged in a plurality of electrode groups 126A–126N are distributed along and supported by a rotating shaft 128. The electrode groups 130A, 130B and 130D are designated controlled electrode groups, while the electrode group 130C is designated the reference electrode group. An array of brushes, arranged in a corresponding plurality of brush groups 130A–130N are supported by a brush support block 132 such that each rotating disc electrode is contacted by its mating stationary brush at a single contact point. This is shown illustratively (by a single point only) at 134 on the reference group of electrodes 126C. As the disc electrodes, brushes, and associated elements carry moderately high voltages, suitable insulation means are disposed throughout the assembly. For example, dis electrodes of groups 126A–126N are insulated from each other by disc insulators (not shown) and all electrodes are insulated from the rotating shaft 128 by an elongated insulating cylinder (not shown). For a detailed description of an electrode assembly suitable for use in the present context, the teachings contained in the aforementioned U.S. Pat. No. 4,029,938 to Martin and U.S. Pat. No. 4,035,611 to Martin et al should be referred to. Both of these patents are assigned to the same assignee as the present invention.

The electrode groups 126A–126N are arrayed in predetermined proximity to the moving web 12, which is transported between the electrode groups and a ground electrode 136. The ground electrode may be formed as an endless metallic (steel) band positioned to pass around sheaves 138 and 140, both of which are rotatably mounted on a base member (not shown), and driven by a drive motor (not shown). A plurality of switching assemblies 142A, 142B and 142D are interposed between a selected few brushes of brush groups 130A, 130B and 130D, and are controlled by signals supplied via lines 144, 144A, 144B and 144D. By momentary reference to FIG. 5A, it is seen that the switching assemblies comprise a first Add relay which actuates a first SPST switch, and a second Remove relay which actuates a second SPST switch. The Add and Remove relays of FIG. 5A, and those contained in the switching assemblies 142, are the same relays discussed (as Add relay 112 and Remove relay 120) in connection with the logic unit 20 of FIG. 4. It is preferable for electrical reasons that the relays be located as close as feasible to the brushed and electrodes with which they are associated. The Add relay 112 is shown in its de-energized condition and the corresponding state of its switch contacts are shown as normally opened. Thus, in the de-energized condition, any perforation electrode associated with a de-energized Add relay is disconnected from the excitation unit 122 and is not actively used to perforate its corresponding portion of the web. The Remove relay 120 is also shown in its de-energized condition and the corresponding state of its switch contacts are shown as normally closed. In the de-energized condition, any perforating electrode associated with a de-energized Remove relay is connected to the excitation unit 122 and is actively perforating its related portion of the web. In the preferred embodiment of FIG. 5, each controllable electrode group has six electrodes, two of which are selectively energized by action of the switching assemblies. With both relays in the switching assemblies de-energized, five electrodes are actively used for web perforation; with only the Add relay 112 energized six electrodes are actively used; and with only the Remove relay 120 energized, four electrodes are actively used.

The illustrative embodiments described above can be configured to operate in three major modes, two of which are the subjects of the present invention.

In a basic temporal control operating mode, the electrode excitation assembly 122 provides duty-cycle-modulated pulses of high voltage via a group of lines 146 to a plurality of current isolation networks (not shown) housed in the support block 132, and thereafter via the individual brush groups 130A–130N to all of the perforation electrodes in parallel. The web 12 is therefore perforated by the electrostatic discharge arcs established between the perforation electrodes and the ground electrode 136. The pulse repetition rate and the pulse duration of the discharge arcs is controlled in accordance with signals produced by porosity sensing means associated with perforation lane 26C. This is as disclosed in the aforementioned U.S. Pat. No. 4,025,752. The implication of this is that the full width of the web 12 is perforated with reference to a porosity sensor which is sensing only a part of the web width. Uneven electrode wear and other factors, causing uneven porosity distribution transversely across the web are not detected nor controlled.

In an advanced operating mode, a combined temporal and spatial porosity control mode is implemented. This mode may be briefly summarized as including the logical control of the number of electrodes in the controllable electrode groups 126A, 126B and 126N which are actually energized—in addition to the temporal mode outlined above.

Functional description of this combined mode may be detailed with reference to FIGS. 2–5A, and to Table 1.

Consider initially the system condition I, the balance condition, detailed in the second column of Table 1. The Add, Remove, Reset Remove and Reset Add signal levels contained in rows 4–7 are taken directly from inspection of the states of the four light detectors of FIG. 2. The use of positive true logic is assumed throughout this description for ease of visualization. Actual implementation of the circuitry could, of course, deviate from this logic convention whenever appropriate to achieve circuit efficiencies or some other benefit. These signal levels correspond to "0" signals sensed by light detector 58 (Add) and light detector 54 (Remove), due to the absence of opaque fluid 52 in their paths, and to "1" signals sensed by light detector 60 (Reset Remove) and light detector 56 (Reset Add) due to the presence of opaque fluid 52 in their paths. When the system sequencer 70 reaches the part of its cycle wherein it provides a select signal, an enabling logic level, via the line 74A to the switching module 72A, the internal logic circuitry is acted upon by the four porosity control signals of lines 76–82 to control the Add relay 112 and Remove relay 120 as shown in rows 8 and 9. Relay actuation results in connecting the number of perforating electrodes as shown in row 10. Specifically, for the balanced condition, both relays are de-energized, shown as DE, and five perforating electrodes are in use for the electrode group corresponding to the switching module 72A. This condition is as shown for the perforating lane 26B of FIG. 3.

Consider next system condition II of Table 1, column 3, wherein the scanning porosity detector 48 senses web porosity in a particular lane which is less than that sensed in the reference lane by reference detector 38. This condition induces an upward shift of liquid 52 in the scanning branch side of manometer 42. If the differential porosities sensed is of sufficient magnitude, the opaque fluid 52 will rise until the light detector 58 (Add) produces a "1" signal which initiates a first type of operation of the switching module associated with that particular lane. With reference to the switching module 72A, illustratively, this "1" signal produces a high logic level at the output of AND gate 84 due to the combined presence of the Add signal on line 76 and the enabling signal from the system synchronizer 70 on the line 74A. The latch comprising OR gate 94 and the cross-coupled exclusive OR 110 forced by the output of AND gate 84 to a condition wherein the output of OR gate 94 is a high logic level, thereby energizing the Add relay 112. Add relay 112, as described in connection with FIG. 5A, adds a perforating electrode to the particular group of electrodes being processed thereby increasing the web porosity in that lane. The system parameters of rows 4 through 10 of Table 1 summarize this condition. Note that the Remove relay, row 9, continues to be de-energized and that six electrodes, row 10, are in active use. This condition is as shown in FIG. 3 as illustratively the perforation line 26E. System condition II will persist, due to circuit latching action, until either a Reset Add signal is produced by light detector 56 (Reset Add) due to a downward shift of fluid 52 from the left side of manometer 42; or a Remove signal is produced by light detector 54 (Remove) due to a substantial upward shift of fluid 52 into the right side of manometer 42.

System condition III of Table 1, column 4, represents the condition wherein the scanning porosity detector 48 senses web porosity in the lane being processed which is greater than that sensed in the reference lane. This leads to an upward shift of liquid 52 in the reference branch side of manometer 42. When the differential porosities sensed is of actionable magnitude, the fluid 52 will rise until the light detector 54 (Remove) produces a "1" signal which initiates a second type of operation of the switching module associated with the lane under consideration. With reference to switching module 72A, illustratively, this "1" signal produces a high logic level at the output of AND gate 90 due to the combined presence of the Remove signal on line 78 and the enabling signal from the system synchronizer 70 on the line 74A. The latch comprising OR gate 100 and the cross-coupled exclusive OR 118 is forced to a condition wherein the output of OR gate 100 is a high logic level thereby energizing the Remove relay 120 and removing a perforating electrode from the electrode group being processed. This effects a porosity decrease in that lane thereby counteracting the previously sensed porosity greater than that of the reference lane. The system parameters of rows 4–10 summarize this system condition, which is shown in FIG. 3, illustratively, as the web perforations of lanes 26A and 26D.

The three system conditions of Table 1 constitute the major operating states for the control logic unit/manometer assembly produced porosity control signals interactions. Transitional states of the switching modules as they respond to changes between the variously selected lanes, or to partial excursions of the fluid 52, are straightforward and follow directly from circuit action as reflected in the system parameters tabulated in Table 1.

In an alternate advanced operating mode, the apparatus described above can be configured to operate predominately in a spatial porosity control mode. In this mode, designated the spatially distributed perforation mode, the electrode excitation assembly 122 of FIG. 5 is selectively disabled and web porosity is controlled in substantial part by an expanded operation of the switching assemblies 142. Briefly, the spatially distributed mode contemplates setting the pulse repetition rate and pulse width of the pulse generator 16* at some predetermined average values, in lieu of using the control circuitry of U.S. Pat. No. 4,025,752; and further setting the output of the reference porosity detector 38 at some desired predetermined, mechanically fixed, porosity equivalent. For higher degrees of porosity vernier action in each lane, the number of controllable electrodes in each group of six electrodes as shown in FIG. 5 may be increased to, say, five controllable electrodes out of six. Therefore, instead of controlling the number of active electrodes in each lane used to track the porosity of a reference lane, the spatial control mode would control the number of active electrodes in each lane used to track the porosity equivalent set into the control system. The desired porosity equivalent may be established in a simplified form, using a precision specimen web in combination with the reference porosity detector 38, or alternatively, by use of a precision aperture equivalent in lieu of detector 38.

Although the invention has been described in terms of selected preferred and alternate embodiments, the invention should not be deemed limited thereto, since other embodiments and modifications will readily occur to one skilled in the art. It is therefore to be understood that the appended claims are intended to cover all such modifications as fall within the true spirit and scope of the invention.

TABLE I

| | 1 | 2 | 3 | 4 |
|---|---|---|---|---|
| 1 | System Condition | Balanced | Scanning Porosity Less Than Reference | Scanning Porosity Greater Than Reference |
| 2 | Correction Amount | None | Full | Full |
| 3 | Condition No. | I | II | III |
| 4 | Add | 0 | 1 | 0 |
| 5 | Remove | 0 | 0 | 1 |
| 6 | Reset Remove | 1 | 1 | 0 |
| 7 | Reset Add | 1 | 0 | 1 |
| 8 | Add Relay | DE | EN | DE |
| 9 | Remove Relay | DE | DE | EN |
| 10 | No. Electrodes in Use | 5 | 6 | 4 |

We claim:

1. A method for controlling the porosity of webs being moved in a longitudinal direction and being perforated by electrical arcs of an array of electrodes distributed in a transverse direction, comprising:

(a) generating a high voltage pulse train having a predetermined constant pulse rate and pulse width;

(b) generating a porosity difference control signal between a first porosity detector and a second porosity detector for each of a plurality of transverse positions on said web;

(c) applying said pulse train to all of said electrodes via a circuit having switching means interposed between selected individual electrodes; and (d) utilizing said porosity difference control signals to selectively actuate said switching means.

2. The method of claim 1, wherein said first porosity detector is a stationary reference detector and said second detector is a variably positioned detector.

3. The method of claim 2 wherein said variably positioned porosity detector is periodically repositioned to provide at least one porosity difference signal for each of said plurality of transverse positions.

4. The method of claim 1, wherein said first detector is a stationary reference detector and said detector comprises a plurality of detectors positioned at each of said plurality of transverse positions on said web.

5. The method of claim 4, wherein said control signal generating step further comprises selecting the output of a particular one of said plurality of detectors, and said utilizing step further comprises selectively actuating the particular switching means corresponding to the closest related web position so as to reduce the magnitude of said porosity difference control signal.

6. A method for controlling the porosity of webs being moved in a longitudinal direction and being preforated by electrical arcs of an array of electrodes distributed in a transverse direction, comprising:

(a) generating a high voltage pulse train having controllable pulse rates and widths;

(b) generating a porosity difference control signal between a stationary reference porosity detector and a variably positioned porosity detector;

(c) generating a temporal control signal corresponding to the difference between an output of said reference porosity detector and a preset porosity set signal;

(d) applying said pulse train to all of said electrodes via a circuit having switching means interposed between selected individual electrodes;

(e) utilizing said temporal control signals to control said controllable pulse rates and widths; and (f) utilizing said porosity difference control signals to selectively actuate said switching means.

7. A method for controlling the porosity of webs being moved in a longitudinal direction and being perforated by electrical arcs of an array of electrodes distributed in a transverse direction, comprising:

(a) generating a high voltage pulse train having a predetermined constant pulse repetition rate and duration;

(b) generating a porosity difference control signal between a stationary porosity detector and a variably positioned porosity detector for each of a plurality of transverse positions on said web;

(c) applying said pulse train to all of said electrodes via a distribution bus having switching means interposed between selected individual electrodes and said bus thereby selectively perforating said web; and (d) utilizing said porosity difference control circuit to selectively actuate said switching means.

* * * * *